US007021966B2

(12) United States Patent
Ikeda et al.

(10) Patent No.: US 7,021,966 B2
(45) Date of Patent: Apr. 4, 2006

(54) COAXIAL CONNECTOR

(75) Inventors: Kazuhiko Ikeda, Tokyo (JP); Naoyuki Asano, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 2 days.

(21) Appl. No.: 10/895,939

(22) Filed: Jul. 22, 2004

(65) Prior Publication Data

US 2005/0026498 A1 Feb. 3, 2005

(30) Foreign Application Priority Data

Jul. 30, 2003 (JP) ..... 2003-282488

(51) Int. Cl.
*H01R 9/05* (2006.01)

(52) U.S. Cl. ..... 439/582

(58) Field of Classification Search ..... 439/582, 439/578–581, 583–585, 350–358
See application file for complete search history.

(56) References Cited

U.S. PATENT DOCUMENTS 5,263,877 A * 11/1993 Mitani ..... 439/585
5,772,470 A * 6/1998 Togashi ..... 439/582
6,508,668 B1 * 1/2003 Yamane ..... 439/582
6,572,407 B1 * 6/2003 Ko ..... 439/582
6,676,445 B1 * 1/2004 Hall et al. ..... 439/582
6,790,082 B1 * 9/2004 Obayashi ..... 439/582

FOREIGN PATENT DOCUMENTS

JP 2001-43939 2/2001
JP 2003-059593 2/2003

* cited by examiner

*Primary Examiner*—Gary F. Paumen
(74) *Attorney, Agent, or Firm*—Takeuchi&Kubotera, LLP

(57) ABSTRACT

A right angle coaxial connector is fitted into a corresponding connector in a fitting direction substantially perpendicular to a direction that a connecting cable extends. The right angle coaxial connector includes an outer conductor having a cylindrical portion with an axial line in the fitting direction and a lid portion covering an inner space of the cylindrical portion and extending over a covering portion of the connecting cable. The lid portion is integrated with the cylindrical portion at a part of a periphery of the cylindrical portion through a bent connecting portion. The lid portion includes a holding portion at an extending end thereof for pressingly holding the connecting cable. The cylindrical portion includes engaging portions for engaging the corresponding connector. One of the engaging portions located at a position where the cable extends has an engaging amount larger than that of the other engaging portions at other positions.

7 Claims, 5 Drawing Sheets

FIG. 1(A)
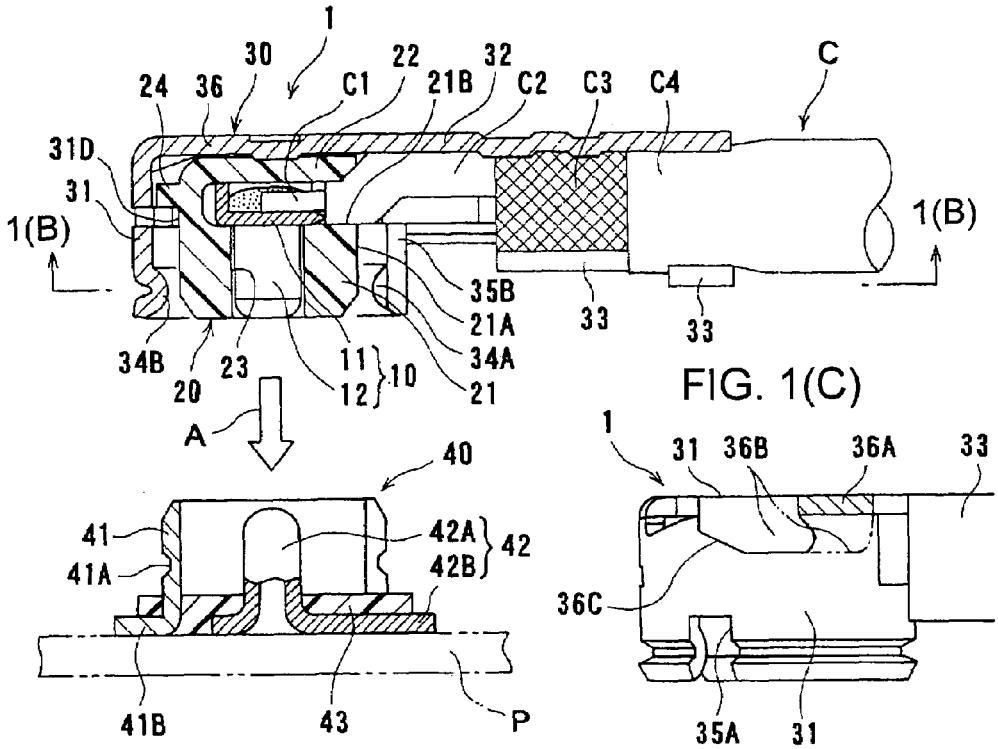
FIG. 1(C)
FIG. 1(B)
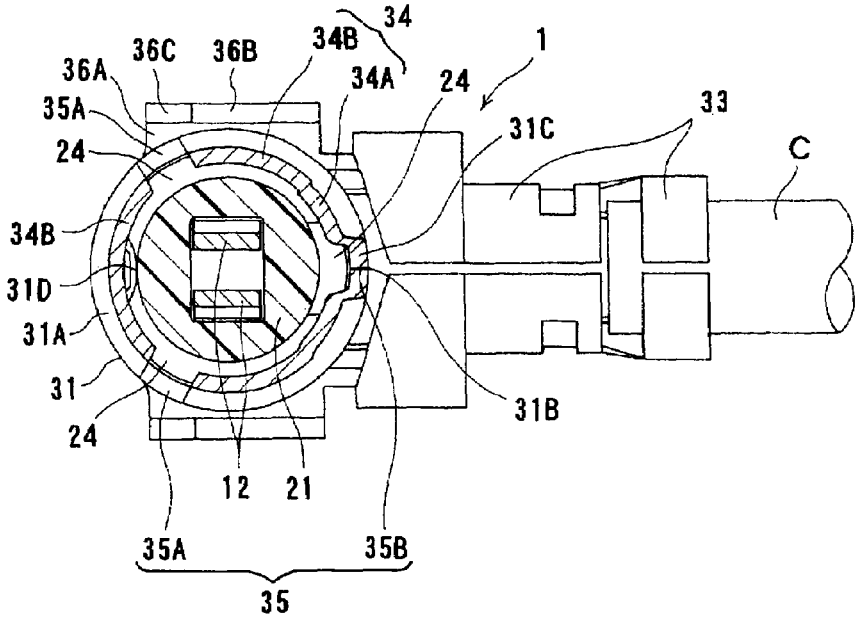

COAXIAL CONNECTOR

BACKGROUND OF THE INVENTION AND RELATED ART STATEMENT

The present invention relates to a coaxial connector, especially, a right angle coaxial connector.

A coaxial connector called a right angle coaxial connector is fitted into a corresponding connector in a direction perpendicular to a direction that a coaxial cable extends, and has been widely used for connecting a circuit board.

As disclosed in Japanese Patent Publication No. 2001-43939, a conventional right angle coaxial connector includes an outer conductor having a cylindrical portion to be connected to an external terminal of a corresponding connector, and a lid portion integrated with the cylindrical portion for covering an upper portion of the cylindrical portion. In forming the outer conductor, a metal plate is first press-molded to form the cylindrical portion, and then the metal plate is bent to form the lid portion. The cylindrical portion is connected to the lid portion at a part of a periphery thereof opposite to a side where a cable extends. The lid portion extends over a covering portion of the cable, and pressingly holds the cable at a holding portion.

The cylindrical portion is provided with an annular engaging projection on an inner surface thereof. A plurality of slits extends along an axial direction for dividing the annular engaging projection into a plurality of contacting portions. Accordingly, the annular engaging projection is able to elastically deform in a radial direction to easily engage the corresponding connector.

In the coaxial connector disclosed in Japanese Patent Publication No. 2001-43939, each of the contacting portions formed on the inner surface of the cylindrical portion has an engaging projection having a same height in the radial direction. Among the contacting portions forming the cylindrical portion, one contacting portion located at a position where the cable extends is provided with a cut at a side of the lid portion for providing a space through which the cable extends. Accordingly, the one contacting portion has rigidity lower than that of other contacting portions. In other words, the one contacting portion bends more easily than the others do when an external force is applied. In general, when a metal plate is bent and formed in a cylindrical shape to form the cylindrical portion, end portions of the metal plate meet at the one contacting portion located at a position where the cable extends. This structure also contributes to the lower rigidity of the one contacting portion.

In the right angle coaxial connector, especially in a small size connector, when an external force is applied to the cable, the coaxial connector receives a pulling force with an angle relative to an axial line. In this case, the one contacting portion located at a position where the cable extends tends to deform in the radial direction easily as compared with the others, thereby inadvertently disconnecting the coaxial connector.

Recently, a size of electronic device has been greatly reduced, and a size of electronic part has been required to be small in a thickness direction of a circuit board. In this trend, a right angle coaxial connector tends to have a cylindrical portion with a shorter length in a direction that the connector is connected. Accordingly, such a connector is disconnected more easily when an external force is applied to a cable.

SUMMARY OF THE INVENTION

In view of the problems described above, it is an object of the present invention to provide a coaxial, in which a cylindrical portion is structured such that the coaxial connector is not disconnected easily when an external force is applied to a cable.

In order to achieve the object described above, according to an embodiment of the present invention, a coaxial connector is connected to a corresponding connector in a direction perpendicular to a direction that a connecting cable extends, and is generally called a right angle coaxial connector. The right angle coaxial connector includes an outer conductor having a cylindrical portion with an axial line aligned in a direction that the coaxial connector is connected to the corresponding connector, and a lid portion covering an inner space of the cylindrical portion at a side opposite to a side where the coaxial connector is connected and extending over a covering portion of the connecting cable. The lid portion is integrated with the cylindrical portion through a bent connecting portion at a part of a periphery of the cylindrical portion. The lid portion is provided with a holding portion for pressingly holding the cable at a distal end thereof in a direction that the lid portion extends. The cylindrical portion is provided with engaging portions for engaging the corresponding connector on a periphery thereof when the coaxial connector is connected to the corresponding connector.

In the coaxial connector of the present invention, one of the engaging portions located at a side where the cable extends has an engaging amount larger than that of the other engaging portions.

The engaging portions prevent the coaxial connector from being pulled out when the coaxial connector is connected to the corresponding connector. The engaging portions are formed in an annular shape, or are disposed at a plurality of positions. In the present invention, one engaging portion located at a position in a circumference direction where the cable extends has an engaging amount, i.e. a depth of an engaging portion engaging an engaging portion of the corresponding connector (dimension in a radial direction), larger than that of the other engaging portions located at other positions. The position where the one engaging portion is located has a smaller length in the axial direction for providing a space for the cable. Accordingly, when an external force is applied to the cable after the coaxial connector is connected, the one engaging portion deforms to expand in the radial direction more easily than the other engaging portions. However, the one engaging portion has the larger engaging amount to maintain the engagement with the corresponding connector. As a result, the coaxial connector engages the corresponding connector uniformly around the circumference direction. Therefore, it is possible to prevent the axial connector from being pulled out at a specific position in the circumference direction.

According to the present invention, as an embodiment of the outer conductor, the lid portion may have projecting portions facing each other in the radial direction of the cylindrical portion and projecting from the cylindrical portion. Also, a plurality of slits is formed along the axial direction at a plurality of positions in the circumference direction, so that a plurality of contacting springs is formed. When a tool hooks the projecting portions opposed in the radial direction and the tool is pulled in the axial direction, it is possible to pull out the coaxial connector without inclining in the axial direction. The contacting springs are formed by the slits, and easily deform to expand in the radial direction when the axial connector is pulled out.

The outer conductor may be formed through press-molding a metal plate. In this case, the engaging portions are formed as a projection or a groove in the radial direction of the cylindrical portion according to the corresponding connector. When the metal plate is press-molded, the one engaging portion at the position in the circumference direction where the cable extends is formed to have the larger engaging amount, i.e. a larger projecting amount of the projection or a deeper depth of the groove, than that of the other engaging portions.

The projecting portions are formed on the lid portion for engaging the tool when the coaxial connector is pulled out. It is preferred that the projecting portions are provided with reinforcing portions at free ends bent in the direction that the coaxial connector is connected. With the reinforcing portions, the projecting portions are difficult to deform when the tool applies a pulling up force.

Further, it is preferred that the reinforcing portion has a corner cut in a tapered shape and adjacent to the bent connecting portion connected to the cylindrical portion. If the corner has the right angle or round shape, the tool for pulling out the connector abuts against only the corner and is inclined, so that the tool does not contact a lower edge of the reinforcing portion over the whole length thereof. As a result, the tool is easy to come off. The lid is connected to the cylindrical portion through the connecting portion within a limited area. The corner is located near the connecting portion, and a point of application is far from the connecting portion, i.e. a base point receiving the bending force. Accordingly, the projecting portions receive a large bending moment, thereby applying the pulling force on a weak site of the projecting portions.

The lid portion firmly holds the cable with the holding portion thereof at a side where the cable extends. Therefore, when the corner is cut in a tapered shape, the tool abuts against the projecting portions at a side where the cable extends, so that the holding portion as well supports the pulling force. In this case, the point of application is near the base point, thereby reducing bending moment. Accordingly, the projecting portions do not deform with the pulling force.

According to the present invention, the engaging portion of the corresponding connector is formed in an annular groove. In this case, a top of the engaging portion projects discontinuously, thereby increasing the amount of the projection.

In the present invention, the engaging portion engaging the corresponding connector is formed on the circumference surface of the cylindrical portion of the outer conductor. The engaging portion at a position where the cable extends has the larger engaging amount than the other engaging portions in the circumference direction, thereby engaging the engaging portion of the corresponding connector more deeply. Accordingly, when an external force is applied to the case and the engaging portion at a position where the cable extends deforms to expand in the radial direction more greatly than the other engaging portions do, the engaging portion engages the corresponding engaging portion of the corresponding connector deeply enough to compensate the deformation. As a result, when an external force is applied, the engaging portion maintains the engaging state same as the other engaging portions do, thereby eliminating an easy coming off portion.

BRIEF DESCRIPTION OF THE DRAWINGS

FIGS. 1(A) to 1(C) are views showing a right angle coaxial connector according to an embodiment of the invention, wherein FIG. 1(A) is a sectional view of the right angle connector before being connected to a corresponding connector, FIG. 1(B) is a sectional view thereof taken along a line 1(B)—1(B) in FIG. 1(A), and FIG. 1(C) is a partial sectional view thereof;

FIGS. 2(A) to 2(C) are enlarged views showing an engaging portion of the coaxial connector, wherein FIG. 2(A) is a view showing a shape of an engaging portion at a position in a circumference direction other than a position that a cable extends, FIG. 2(B) is a view showing a shape of an engaging portion at a position in the circumference direction that the cable extends, and FIG. 2(C) is a view showing a modified shape of the engaging portion shown in FIG. 2(B);

FIGS. 4(A) and 4(B) are views showing a coaxial connector according to another embodiment, wherein FIG. 4(A) is a sectional view thereof including an axial line, and FIG. 4(B) is a sectional view thereof taken along a line 4(B)—4(B); and FIGS. 5(A) and 5(B) are views showing a tool for pulling out the coaxial connector and an operation thereof, wherein FIG. 5(A) is a plan view showing the coaxial connector when the tool is used, and FIG. 5(B) is a perspective view showing an essential part of the tool.

DETAILED DESCRIPTION OF THE PREFERRED EMBODIMENTS

Figure 2A:
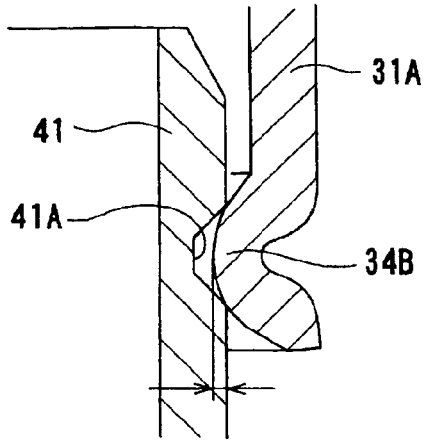

Hereunder, embodiments of the present invention will be explained with reference to the accompanying drawings. FIGS. 1(A) to 1(C) are views showing a right angle coaxial connector according to an embodiment of the invention, wherein FIG. 1(A) is a sectional view of the right angle connector before being connected to a corresponding connector, FIG. 1(B) is a sectional view thereof taken along a line 1(B)—1(B) in FIG. 1(A), and FIG. 1(C) is a partial sectional view thereof.

A coaxial connector 1 has a central conductor 10 and an outer conductor 30 integrated together via a dielectric member 20. A coaxial cable C is connected to the connector 1. The central conductor 10 is formed of a molded metal plate. As shown in FIG. 1(A), the central conductor 10 has a connecting portion 11 having an L shape section and a pair of contacting portions 12 having an elastic tongue shape and extending downwardly from the connecting portion 11 in parallel to each other. A core wire C1 of the coaxial cable C is connected to the connecting portion 11 with solder and the like. A pair of contacting portions 12 receives a central conductor 42 in between, and elastically contacts the central conductor 42.

The dielectric member 20 is formed of a molded resin, and a column portion 21 and a press plate 22 integrated with each other. The column portion 21 is provided with a rectangular hole 23 at a central portion thereof passing through in a vertical direction for receiving the contacting portions 12 of the central conductor 10 from above. An outer periphery 21A of the column portion 21 is formed in a cylindrical surface. An upper surface 21B of the column portion 21 is a flat surface for placing the connecting portion 11 of the central conductor 10 thereon.

The press plate 22 of the dielectric member 20 stands upwardly from a left side of the supper surface of the column portion 21 when the dielectric member 20 is molded. As shown in FIG. 1(A), when the cable is connected to the coaxial connector, the press plate 22 is bent to be in parallel to the upper surface of the column portion 21. The press plate 22 and the upper surface 21B of the column portion 21 hold the connecting portions 11 of the central conductor 10 and a cover C2 of the core wire C1 in between. The dielectric member 20 has a plurality of projections 24 on the outer periphery of the column portion 21 for positioning and engaging the outer conductor 30.

The outer conductor 30 has a cylindrical portion 31 and a lid portion 32, and is formed in a molded metal plate. In manufacturing, a flat metal plate is formed in a specific unfolded shape, and a part of the plate is bent in a cylindrical shape to form the cylindrical portion 31. After the dielectric member 20 connected to the cable is retained in the cylindrical portion 31, the lid portion 32, which extends from a connecting portion formed at an upper left portion of the cylindrical portion 31, is bent in the right angle while pressing the press plate 22 of the dielectric member 20. Then, as shown in FIG. 1(A), a holding portion 33 formed on the lid portion 32 is deformed to pressingly hold a shield wire C3 and an outer cable cover C4. A structure in which the outer conductor 30 holds the dielectric member 20 and the cable is known, and a detailed explanation is omitted.

The cylindrical portion 31 of the outer conductor 31 has a cylindrical shape, and is coaxial with the outer periphery 21A of the column portion 21 of the dielectric member 20. An annular space is formed between the cylindrical portion 31 and the outer periphery 21A of the column portion 21, so that the outer conductor 41 of the corresponding connector is inserted therein.

The cylindrical portion 31 is provided with engaging portions 34 formed of an annular projection on a lower inner surface thereof. Slits 35 (two slits 35A having a relatively large width and one narrow silt 35B) having lower openings are formed in the axial direction (direction that the connector is connected) along the circumference direction. With the slits 35, the cylindrical portion 31 has three contacting springs 31A having an arc section. The engaging portions 34 crossing the slits 35 are formed on inner surfaces of the contacting springs 31A, respectively.

In the embodiment, the engaging portions 34 include engaging portions 34A at a position in the circumference direction close to the direction that the cable extends and engaging portions at other positions. The engaging portions 34A project by an amount larger than that of the engaging portions 34B (see FIGS. 1(B), 2(A) and 2(B)). The engaging portions 34A with the large projection are formed in the circumference direction at both sides of a connecting portion 31B (forming the narrow slit 35B), which is formed when the cylindrical portion 31 is formed in the cylindrical shape. Accordingly, it is easy to provide the engaging portions 34A with the large projection inwardly in the radial direction and increase rigidity at the connecting portion. The cylindrical portion 31 is also provided with a recess portion 31D recessed inwardly in the radial direction by cutting at a position opposite to the connecting portion 31B. The recess portion 31D engages the dielectric member 20 in the axial direction.

As shown in FIG. 1(A), the lid portion 32 of the outer conductor 30 is bent at the connecting portion in the right angle relative to the axial line of the cylindrical portion 31. The lid portion 32 has a covering portion 36 covering the cylindrical portion 31 from above and pressing the press plate 22 of the dielectric member 20, and the holding portion 33 extending to the shield wire C3 of the cable C and the cable outer cover C4 and bending to press the cable C. As shown in FIGS. 1(B) and 1(C), the covering portion 36 has projecting portions 36A facing with each other in the radial direction of the cylindrical portion 31 and projecting beyond an outer diameter of the cylindrical portion 31. A free end of each of the projecting portions 36A is bent in the right angle to form a reinforcing portion 36B (see also FIG. 1(C)). A lower end of the reinforcing portion 36B has a cut portion 36C having a tapered shape at a corner thereof at a side opposite to the direction that the cable C extends.

The right angle coaxial connector 1 according to the embodiment of the present invention is connected to a corresponding connector 40. As shown in FIG. 1(A), the corresponding connector 40 has the central conductor 42 disposed in the outer conductor 41 formed in a cylindrical shape. A dielectric member 43 holds these conductors at proper positions. The outer conductor 41 is provided with a corresponding engaging portion 41A as an annular groove on a periphery thereof for engaging the engaging portions 34A and 34B formed in the annular projection formed on the cylindrical portion 31 of the outer conductor 30. In the embodiment, the corresponding engaging portion 41A is formed in an annular groove. Alternatively, the corresponding engaging portion 41A may be formed in a simple annular step or an annular projection. Also, the engaging portions 34 or the corresponding engaging portion 41A may not continuously extend around the periphery in an annular shape, and may be formed partially.

The central conductor 42 has a contacting portion 42A formed in a pin shape and a connecting portion 42B formed in a bent shape extending outwardly in a radial direction from a part of a lower periphery of the contacting portion 42A. The connecting portion 42B extends outwardly in the radial direction beyond the outer conductor 41 through a cut portion in the periphery of the outer conductor 41, and is positioned on the same surface of the connecting portion 41B of the outer conductor 41. The connecting portion 41B of the outer conductor 41 and the connecting portion 42B of the central conductor 42 are connected with a corresponding circuit on a circuit board P with solder and the like, so that the connector 40 is fixed to the circuit board P.

As shown in FIG. 1(A), the coaxial connector 1 of the embodiment is fitted in the corresponding connector 40 attached to the circuit board P in the arrow direction A to connect electrically.

Figure 3:
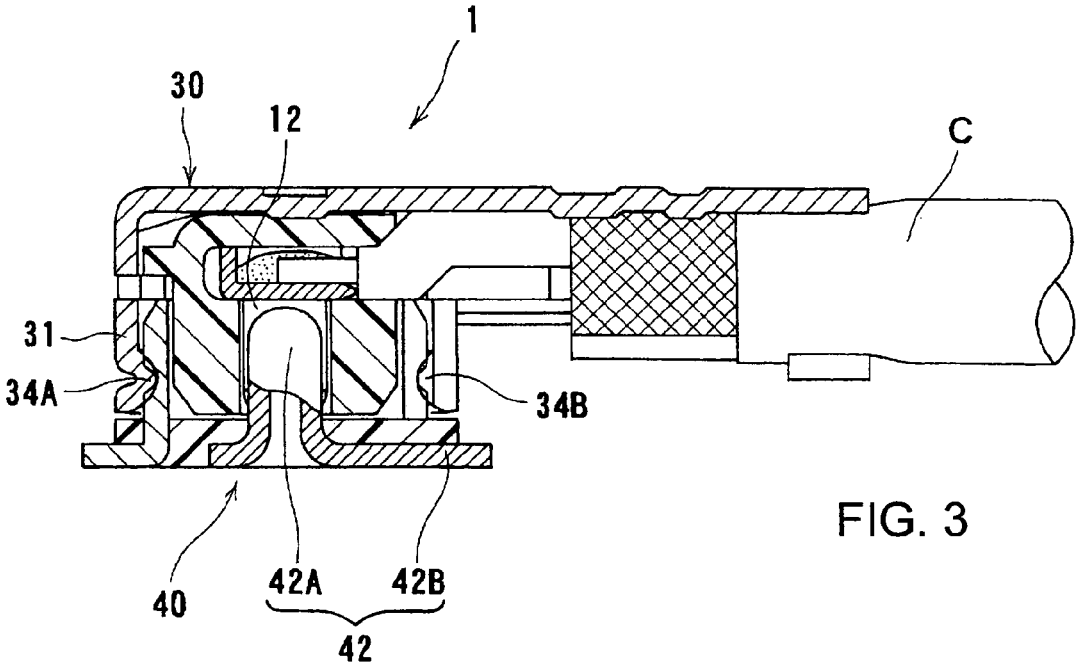
FIG. 3 is a sectional view showing the coaxial connector shown in FIG. 1(A) in a state that the coaxial connector is connected to the corresponding connector.

Upon the fitting, the engaging portions 34 (34A and 34B) abut against the outer conductor 41 of the corresponding connector, so that the three contacting springs 31A with the arc cross section formed in the cylindrical shape deform to expand. Accordingly, the cylindrical portion 31 of the outer conductor 30 of the right angle coaxial connector 1 proceeds to fit into the outer conductor 41 of the corresponding connector. The fitting is completed at a position where the engaging portions 34A and 34B engage the corresponding engaging portion 41A of the corresponding connector (see FIG. 3). At this point, the contacting springs 31 are released from the expansion, and the engaging portions 34A and 34B are fitted in the corresponding engaging portion 41A, so that the connector does not come out. Further, a pair of the contacting portions 12 with a tongue shape in the central conductor of the connector 1 sandwiches the contacting portion 42A with a pin shape in the central conductor 42 of the corresponding connector, so that the contacting portions 12 are connected to the contacting portion 42A.

As described above, among the two engaging portions 34A and 34B formed on the inner surface of the cylindrical portion 31 of the outer conductor 30 of the right angle connector 1, the engaging portions 34A located at the position that the cable extends projects inwardly by an amount larger than that of the engaging portions 34B at the other positions. In other words, the engaging portions 34A have the engaging amount relative to the engaging portion 41A of the corresponding connector larger than that of the engaging portions 34B.

In the right angle connector 1 connected to the corresponding connector 40 in the way described above, when an external force is applied to the extending cable C, for example, an external force pushing the cable upwardly in FIG. 1A, the three contacting springs 31A forming the cylindrical portion 31 of the outer conductor 30 of the right angle connector 1 deform and expand with elasticity. In this case, a portion along the circumference direction close to the direction that the cable extends is easier to expand in the radial direction. This is because the connecting portion 31B forming the cylindrical portion 31 is provided, and the contacting spring 31A has a height shorter than that of other springs along the circumference direction for providing a space at the upper portion thereof to accommodate the cable. However, at the portion close to the direction that the cable extends, even if the contacting spring 31A deforms and expands in the radial direction more greatly than the other portion do, since the engaging portions 34A are formed to have the engaging amount larger than that of the other engaging portions 34B, the engaging portions 34A are not easy to disengage before the other engaging portions 34B disengage, thereby maintaining the same engaged state.

Figure 2B:
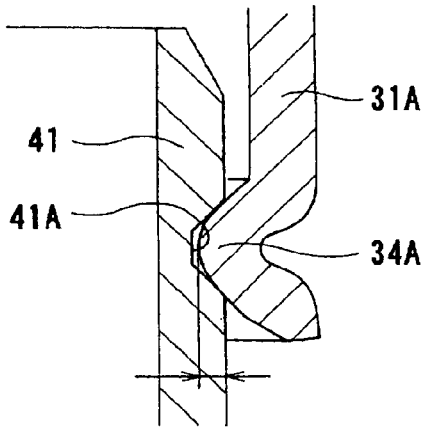
Figure 2C:
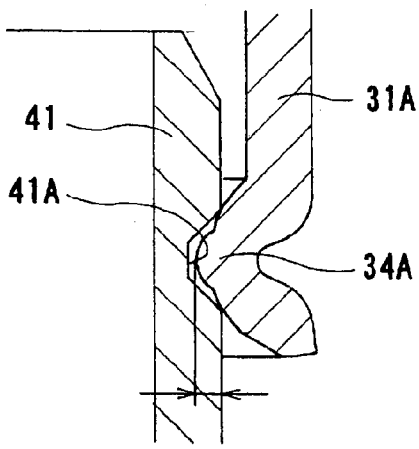

In the embodiment, in a cross sectional view parallel to the axial direction shown in FIG. 2(B), the engaging portion 34A is formed in a large continuous projection to engage the corresponding engaging portion 41A of the corresponding connector. Alternatively, the engaging portion 34A may have a non-continuous shape having two local projections at the top thereof to obtain a large engaging depth.

Figure 4A:
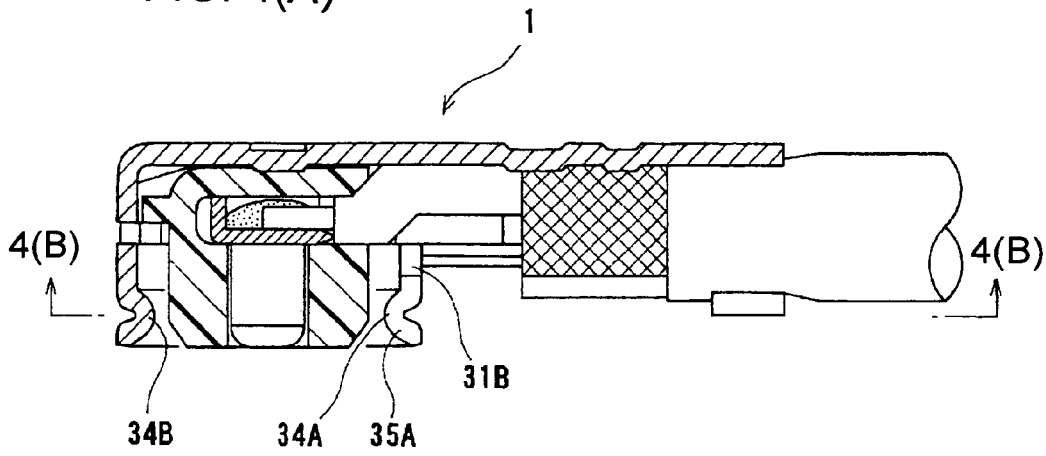
Figure 4B:
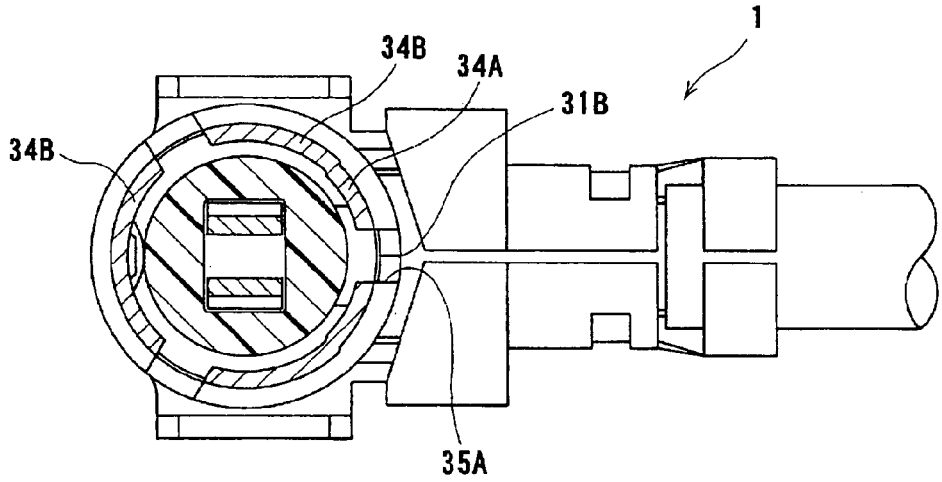

In the coaxial connector according to the embodiment shown in FIGS. 1 to 2(A)–2(C), the cylindrical portion 31 of the outer conductor 30 has the contacting springs 31A divided by the two wide slits 35A and the narrow slit 35B forming the connecting portion 31B, and the projections 31C projecting outwardly in the radial direction are provided adjacent to the connecting portion 31B. Alternatively, as shown in FIGS. 4(A) and 4(B), even when the connector has no projection and the slit 31A at the connecting portion 31B is a wide slit, the engaging portions are formed as well. That is, the engaging portions 34A close to the connecting portion 31B project in the radial direction more greatly than the other engaging portions 34B do.

Figure 5A:
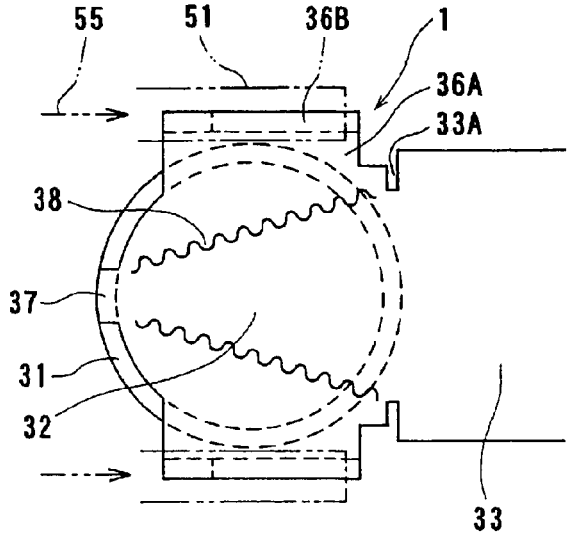
Figure 5B:
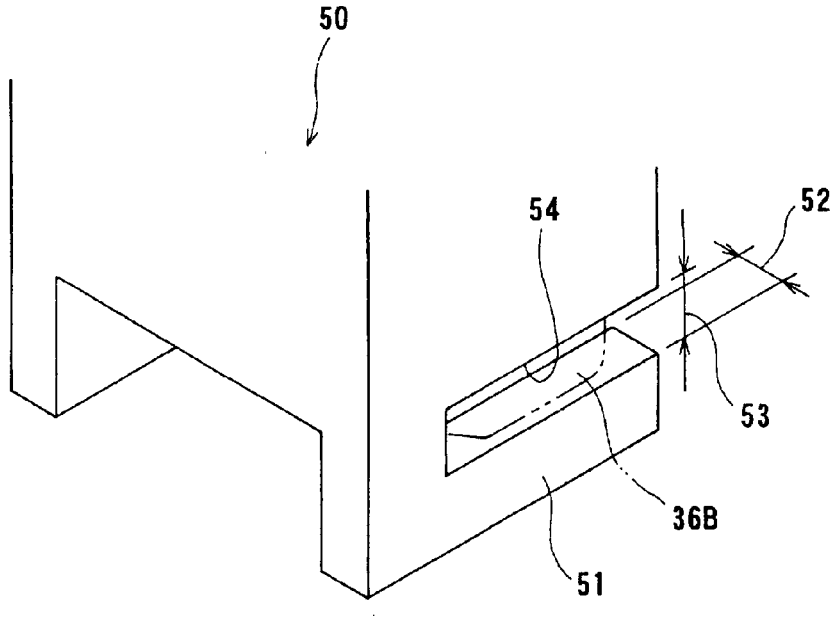

According to the embodiment, the coaxial connector is pulled out of the corresponding connector as shown in FIGS. 5(A) and 5(B). FIG. 5(A) is a plan view of the coaxial connector of the embodiment viewed from above. FIG. 5(B) is a perspective view showing a tool used for pulling out the coaxial connector.

As shown in FIG. 5(B), the tool for pulling out the coaxial connector connected to the corresponding connector is provided with a pair of arms 51 extending from a lower portion in parallel at both sides. A pair of the arms 51 is spaced apart by a distance substantially equal to a distance between the projecting portions 36A of the coaxial connector 1. Each of the arms 51 has a width 52 greater than a width (thickness of the plate) of the reinforcing portions 36B of the projecting portions 36A, so that the width of the reinforcing portions 36B is fitted within the width of the arms 51. Grooves 54 having a groove width 54 are formed between the arms and a main body of the tool 50. The groove width 53 is formed to be slightly larger than a height of the reinforcing portions 36B.

The tool 50 is positioned such that the reinforcing portions 36B are inserted into the grooves 54 in a phantom line arrow direction 55 shown in FIG. 5(A). Then, the tool 50 is lifted upwardly so that the arms abut against the whole area of lower surfaces the reinforcing portions 36B, thereby pulling out the coaxial connector 1.

In the right angle coaxial connector, the lid portion 32 is only partially connected to the cylindrical portion 31 through a connecting portion 37 at a position opposite to the direction that the cable extends. When the pulling force is applied to the projecting portions 36A through the tool 50, the force is concentrated on line areas 38 between the connecting portion 37 and cut portions 33A on a border of the covering portion 36 and the holding portion 33. Accordingly, when a distance from a point of application of the force to the line areas 38 decreases, a degree of bending due to the force decreases.

In the invention, the reinforcing portions 36B are provided with the cut portions 36C formed in a tapered shape at the corners thereof close to the connecting portion 37 (see FIG. 1(C)). Accordingly, the arms 51 of the tool 50 uniformly contact the lower edges of the reinforcing portions 36B over the whole length thereof, so that the distance to the line areas 38 becomes smaller. If the corners close to the connecting portion 37 are formed in an angled shape instead of the cut portions 36 formed in a tapered shape, the arms 51 contact only at angled portions or proximities thereof, so that the distance to the lines areas 38 becomes large and the projecting portions 36A are easy to deform.

Incidentally, in the invention, when the arms 51 of the tool 50 are inserted in a direction opposite to the arrow 55 shown in FIG. 5(A), even if right corners of the reinforcing portions 36B (opposite to the connecting portion 37) have angled portions and the arms 51 contact only the right corners, a distance between the contact points and the line areas 38 is sufficiently large, thereby causing no problem.

What is claimed is:

1. A right angle coaxial connector to be fitted into a corresponding connector in a fitting direction substantially perpendicular to a direction that a connecting cable extends, comprising:

an outer conductor having a cylindrical portion with an axial line in the fitting direction and a lid portion covering an inner space of the cylindrical portion at a side opposite to a connecting side and extending over a covering portion of the connecting cable, said lid portion being integrated with the cylindrical portion at a part of a periphery of the cylindrical portion through a bent connecting portion, said lid portion including a holding portion at an extending end thereof for pressingly holding the connecting cable, said cylindrical portion including engaging portions on the periphery thereof for engaging the corresponding connector, at least one of said engaging portions located at a position where the cable extends having an engaging amount larger than that of the other engaging portions at other positions.

2. The coaxial connector according to claim 1, wherein said lid portion includes projecting portions facing each other in a radial direction of the cylindrical portion and extending beyond the cylindrical portion, and said cylindrical portion includes slits extending in an axial direction thereof at a plurality of positions and a plurality of contacting springs between the slits.

3. The coaxial connector according to claim 1, wherein said cylindrical portion is formed of a press-molded metal plate.

4. The coaxial connector according to claim 2, wherein said projecting portions include reinforcing portions at free ends thereof extending in the fitting direction.

5. The coaxial connector according to claim 4, wherein said reinforcing portions include corners formed in a tapered shape adjacent to the bent connecting portion.

6. The coaxial connector according to claim 1, wherein said at least one of the engaging portions includes a projection having a discontinuous projected top portion to increase the engaging amount.

7. A right angle coaxial connector to be fitted into a corresponding connector in a fitting direction substantially perpendicular to a direction that a connecting cable extends, comprising:

an outer conductor having a cylindrical portion with an axial line in the fitting direction and a lid portion covering an inner space of the cylindrical portion at a side opposite to a connecting side and extending over a covering portion of the connecting cable, said lid portion being integrated with the cylindrical portion at a part of a periphery of the cylindrical portion through a bent connecting portion, said lid portion including a holding portion at an extending end thereof for pressingly holding the connecting cable, said lid portion including projecting portions extending in a radial direction of the cylindrical portion beyond the cylindrical portion and being bent at right angles to form reinforcing portions, said reinforcing portions including corners formed in a tapered shape adjacent to a bent connecting portion, said cylindrical portion including engaging portions on the periphery thereof for engaging the corresponding connector, at least one of said engaging portions located at a position where the cable extends having an engaging amount larger than that of the other engaging portions at other positions; and said cylindrical portion including slits extending in an axial direction thereof at a plurality of positions to provide a plurality of contacting springs between the slits.

* * * * *